US006055705A

United States Patent [19]

Komatsu et al.

[11] Patent Number: 6,055,705

[45] Date of Patent: May 2, 2000

[54] OPENING/CLOSING HINGE CONSTRUCTION FOR A HOUSING

[75] Inventors: Kazuo Komatsu, Tokyo; Takayuki Yamazaki, Shizuoka, both of Japan

[73] Assignee: NEC Corporation, Tokyo, Japan

[21] Appl. No.: 09/106,309

[22] Filed: Jun. 29, 1998

[30] Foreign Application Priority Data

Jun. 30, 1997 [JP] Japan ..... 9-172680

[51] Int. Cl.[7] ..... E05D 1/00

[52] U.S. Cl. ..... 16/225; 16/235; 16/DIG. 13

[58] Field of Search ..... 16/225, 226, 382, 16/385, DIG. 13, 248, 243, 235

[56] References Cited

U.S. PATENT DOCUMENTS

| | | | |
|---|---|---|---|
| 1,043,489 | 11/1912 | Webster | 16/248 |
| 2,241,101 | 5/1941 | Teeter | 16/225 |
| 2,526,129 | 10/1950 | Groesbeck et al. | 16/225 |
| 4,127,214 | 11/1978 | Pedraza | 16/225 |
| 5,067,200 | 11/1991 | Stowell et al. | 16/248 |
| 5,732,757 | 3/1998 | Mariol | 16/225 |

FOREIGN PATENT DOCUMENTS

| | | | |
|---|---|---|---|
| 695905 | 10/1964 | Canada | 16/225 |
| 1333596 | 6/1963 | France | 16/225 |
| 672525 | 11/1989 | Switzerland | 16/225 |
| 240214 | 3/1969 | U.S.S.R. | 16/225 |
| 94002704 A1 | 2/1994 | WIPO | 16/225 |

*Primary Examiner*—Chuck Y. Mah

*Attorney, Agent, or Firm*—Whitham, Curtis & Whitham

[57] ABSTRACT

The present invention relates to an opening/closing hinge construction for an electronic and electrical equipment housing. By improving the hinge construction so that the hinge construction between a body case and body cover is contained within the housing, the housing is prevented from being large-sized and the assembling property is enhanced, whereby the whole manufacturing cost including the assembly cost is reduced. The construction is such as to open and close the body case forming an equipment housing by the body cover of cover member, and a hinge sheet having flexibility formed into a sheet form is used for a hinge connection portion. One end of the hinge sheet is fixed to the interior of the body case by using hinge bosses and set screws as a fixed locking end, and the other end is fixed to the inside of the body cover as a movable locking end. At the movable locking end, two elongated hinge variable adjusting grooves extending in the direction in which the movable locking end is connected to the fixed locking end in the body case are formed in parallel. The hinge sheet is locked at an arbitrary position in the hinge variable adjusting groove via a hinge fixing plate by means of set screws.

9 Claims, 3 Drawing Sheets

OPENING/CLOSING HINGE CONSTRUCTION FOR A HOUSING

BACKGROUND OF THE INVENTION

1. Field of the Invention

The present invention relates to a hinge construction for a housing constructing a body case for various pieces of electronic and electrical equipment especially including communication equipment.

2. Description of the Related Art

Generally, a housing for various pieces of electronic and electrical equipment is made up of a body case and a body cover for opening and closing the body case. In this case, an opening/closing hinge construction between the body case and body cover is configured with consideration given to easy operation in opening and closing and strength and safety in maintenance and storage.

FIG. 3 is an exploded perspective view showing an opening/closing hinge construction for a housing of this type. The housing has a body case 1, which is opened or closed by a body cover 2. The body cover 2 is fastened by screws 3 on one side, and screws 4 are used on the other side, which is a hinged connection portion.

On the hinged connection side, the body case 1 is provided with two sets of brackets 5 of a bearing shape, consisting of right and left sets, and a spindle pin 6 passes through pin holes 5*a* formed in the brackets 5. The body cover 2 is provided with brackets 7 of an L shape in cross section at positions corresponding to the brackets 5 on the side of the body case 1. A pin hole 7*a* is formed at the end portion of the bracket 7 in such a manner that the axis thereof agrees with that of the pin holes 5*a* on the body case side, and the spindle pin 6 is inserted in the pin hole 7*a* together with the pin holes 5*a*.

The bracket 7 provided on the side of the body cover 2 is formed with a slit 7*b* of a U shape, and the screw 4 can be engaged with this slit 7*b*. The screw 4 is screwed at right angles to a screw hole 6*a* formed in the spindle pin 6, and the screw 4 and the spindle pin 6 are integrated with each other into a T shape.

Therefore, as shown in an enlarged portion A of FIG. 3, the body cover 2 is hingedly connected to the body case 1 in a state in which a head 4*a* of the screw 4 is engaged with the U-shaped slit 7*b* in a door bolt form.

When the body cover 2 is opened from the state in which the body case 1 is closed as shown in the enlarged portion A, the screws 3 on one side are loosened and removed. The screws 4 on the hinged connection side are also loosened to a degree such that the screw 4 can be removed from the U-shaped slit 7*b* in the bracket 7 of the body cover 2. Then, as shown in an enlarged portion B, the screws 4 are turned sideways about 90 degrees via the spindle pins 6, so that the screws 4 are removed from the U-shaped slits 7*b* in the brackets 7, by which the body cover 2 can be turned in the direction in which the body cover 2 is opened via the spindle pins 6. Thus, the body cover 2 is opened to open the body case 1.

SUMMARY OF THE INVENTION

The conventional opening/closing hinge construction for a housing shown in FIG. 3 has the following problems to be solved.

One problem is that the equipment is made large-sized by the protruding outside shape of housing because the portion where the brackets 5 and 7 are hingedly connected to each other by the spindle pin 6 protrudes from the outside of the housing.

Another problem is a poor assembling property of the hinged connection portion in the assembly process. In this case, the bracket 5 of the body case 1 and the bracket 7 of the body cover 2 are first engaged with each other, and the spindle pin 6 is inserted in the pin holes 5*a* and 7*a* after the axes thereof are aligned with each other. After the pin insertion, a screw 4 is screwed at right angles to the spindle pin 6. Thereupon, the positioning and connection of parts are very troublesome. For this reason, the assembly man-hour is increased, and therefore the whole manufacturing cost including the assembly cost is increased.

Accordingly, an object of the present invention is to provide an opening/closing hinge construction for an electronic and electrical equipment housing in which by improving the hinge construction so that the hinge construction between the body case and body cover is contained within the housing, the housing is prevented from being large-sized and the assembling property is enhanced, whereby the whole manufacturing cost including the assembly cost can be reduced.

The opening/closing hinge construction for a housing in accordance with the present invention, in which a body cover of cover member is hingedly connected to one end of a body case forming an equipment housing, is configured so that in opening and closing the body case, one end of a hinge member having flexibility formed into a sheet form is locked to the inside surface of the body case, the other end thereof is locked to the inside surface of the body cover, and the hinge member is contained within the housing in a state in which the body case is closed by the body cover.

In this case, when either one of one end and the other end of the hinge member is a fixed locking end, the other is a movable locking end. When one end is the fixed locking end locked to the body case and the other end is the movable locking end locked to the body cover, an elongated hinge variable adjusting groove extending in the direction in which the movable locking end is connected to the fixed locking end is formed at the movable locking end, by which the other end of the hinge member can be locked to the body cover at an arbitrary position in the hinge variable adjusting groove.

That is, the hinge member is of a flexible sheet form, and the hinge member is contained within the housing in a state in which the body case is closed by the body cover, so that it does not protrude from the outside of the housing.

DETAILED DESCRIPTION OF THE PREFERRED EMBODIMENTS

An embodiment of an opening/closing hinge construction for a housing in accordance with the present invention will be described below with reference to the accompanying drawings.

Figure 1:
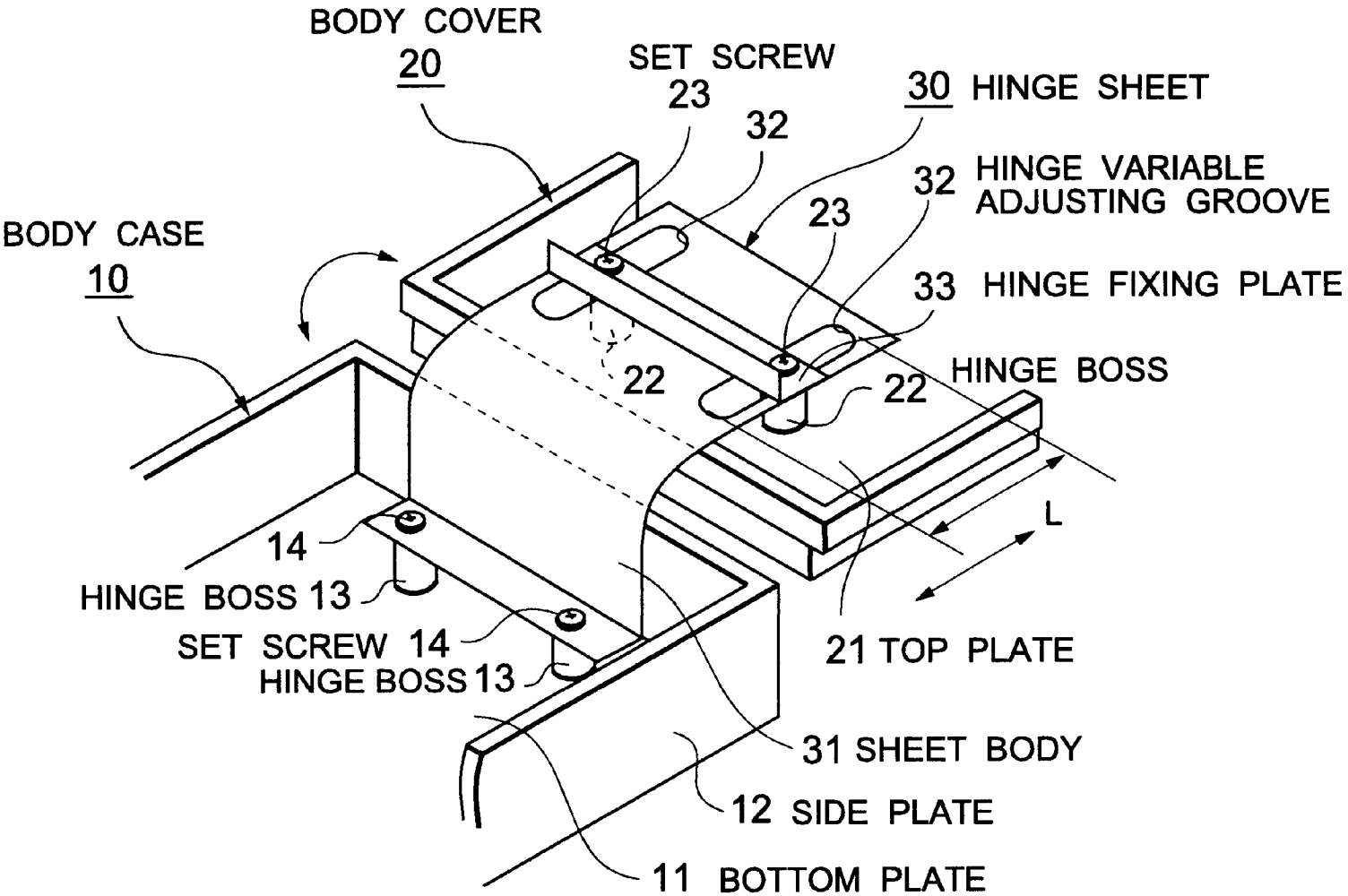
FIG. 1 is a perspective view showing an embodiment of an opening/closing hinge construction for a housing in accordance with the present invention.

FIG. 1 is a perspective view showing a construction of this embodiment. A housing has a body case 10, which is opened or closed by a body cover 20, which is a cover member. The body case 10 has a box shape, being made up of a bottom plate 11 of a planar rectangular shape and side plates 12 erected around the bottom plate 11. In the vicinity of the hinged connection portion with the body cover 20 on the bottom plate 11, a right and left pair of hinge bosses 13 are provided so as to protrude from the surface of the bottom plate 11. The hinge boss 13 is formed with tapped internal threads.

The body cover 20 is also provided with a right and left pair of hinge bosses 22 protruding in the vicinity of hinged connection portion with the body case 10 on the inside surface of a top plate 21 thereof. The hinge boss 22 is also formed with tapped internal threads.

Also, the body cover 20 is hingedly connected to the body case 10 via a hinge sheet 30, which is a principal member of this embodiment, so as to be opened and closed freely. This hinge sheet 30 is formed of a suitable material such that the whole of the sheet body 31 has a rectangular shape and a proper flexibility.

One end side of the sheet body 31 is locked, with set screws 14, to the hinge bosses 13 provided on the bottom plate 11 of the body case 10 at both sides, and the other end side of sheet is locked to the side of the body cover 20.

On the other side where the sheet body 31 is locked to the side of the body cover 20, two hinge variable adjusting grooves 32 are formed in parallel in the lengthwise direction at the positions corresponding to the right and left pair of hinge bosses 22 protrusively provided on the top plate 21 of the body cover 20.

Also, an elongated hinge fixing plate 33 is provided which has a length and shape such as to ride on and extend over the two hinge variable adjusting grooves 32, and both ends of the hinge fixing plate 33 are locked, with set screws 23, to the two hinge bosses 22 located under the hinge fixing plate 33. That is, by fixing the sheet body 31 to the hinge bosses 22 at arbitrary positions of the hinge variable adjusting grooves 32, the length between the hinge bosses 22 and the position fixing hinge bosses 14 on the side of the body case 10 is determined. In other words, the support point length when the body cover 20 is hingedly turned with respect to the body case 10 can be adjusted variably. The variably adjustable length is equivalent to a groove length L of the hinge variable adjusting groove 32 on the side of the hinge sheet 30.

Figure 2:
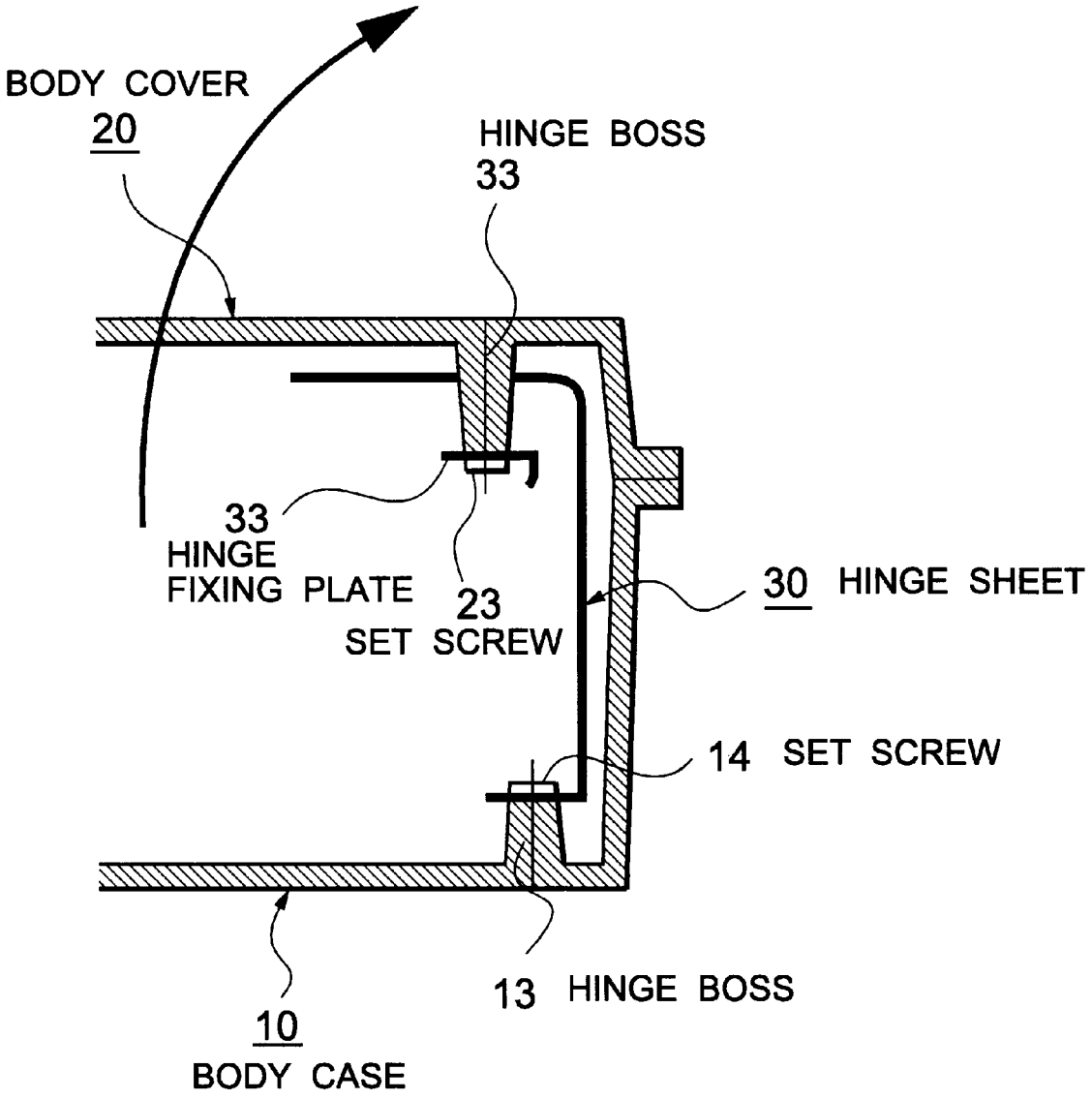
FIG. 2 is a side sectional view of an opening/closing hinge construction of this embodiment.
Figure 3:
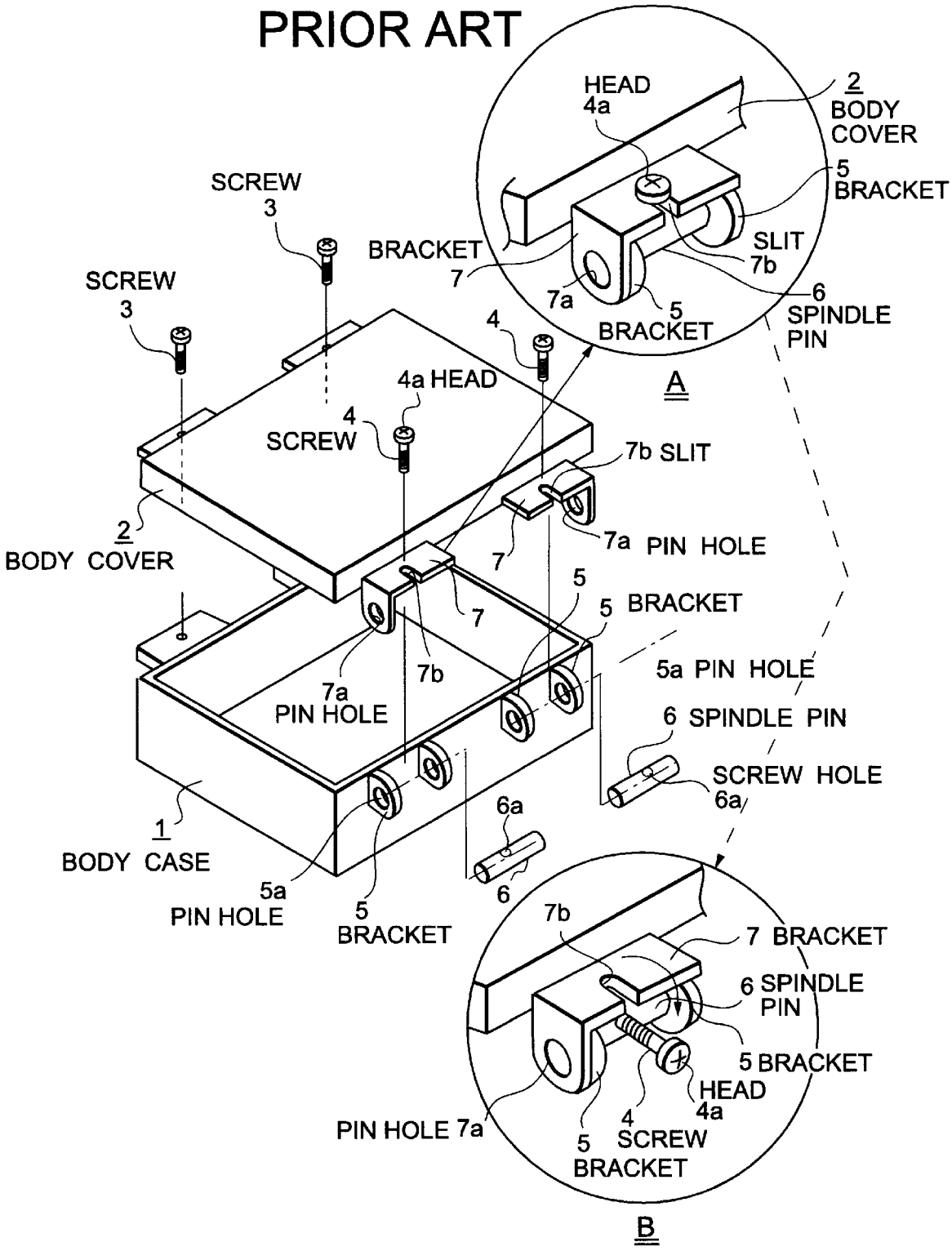
FIG.3 PRIOR ART
FIG. 3 is a partially enlarged exploded perspective view showing a conventional opening/closing hinge construction.

By the above-described construction, as shown in an assembly sectional view of FIG. 2, the body case 10 can be closed by the body cover 20. When the body case 10 is opened from this closed state by opening the body cover 20, for example, a lock (not shown) provided at the left in the figure of the housing is released, and the body cover 20 is turned in the direction indicated by arrow A in FIG. 2 by operating the flexible hinge sheet 30 so as to function as a hinge.

Since one end side of the sheet body 31 of the hinge sheet 30 is fixed by being locked to the side of the body case 10 with set screws 14, the body cover 20 can be turned smoothly with the set screws 14 being used as hinge support points. The hinged turning condition of the body cover 20 with respect to the body case 10 can be adjusted arbitrarily by changing the locking position of the hinge sheet 30. Specifically, if necessary, the set screws 23 in the hinge bosses 22 on the side of the body cover 20 are loosened, and the positions of the hinge bosses 22 in the hinge variable adjusting grooves 32 on the side of the hinge sheet 30 are changed arbitrarily. By tightening the set screws 23 again at the changed positions, the hinge bosses 22 are fixed in the hinge variable adjusting grooves 32 via the hinge fixing plate 33.

Thus, at the hinged connection portion between the body case 10 and the body cover 20, the operating condition by hinged turning in opening and closing can be adjusted freely by changing the distance between both locking portions (between hinge bosses 13 and hinge bosses 22) of the hinge sheet 30 extending over the body case 10 and the body cover 20.

As described above, in the opening/closing hinge construction for a housing in accordance with the present invention, a sheet-formed hinge member having flexibility is used as a hinge portion between the case and the cover constructing the housing, by which the hinge member can be contained within the housing. Therefore, the equipment is prevented from being made large-sized by the hinge portion protruding from the housing like the conventional hinge construction. Also, since the hinge member is of a flexible sheet form, assembling can be performed by screwing easily in a short period of time.

What is claimed is:

1. An opening/closing hinge attached to an equipment housing for opening and closing a body cover of the equipment housing over a body case of the equipment housing by hingedly connecting the body cover to one end of the body case, said opening/closing hinge comprising:

a hinge member comprising a flexible sheet and having a first end being locked to an inside surface of said body case and a second end being adjustably mounted and locked to an inside surface of said body cover, said hinge member being contained within the equipment housing when said body case is closed by said body cover; and at least one elongated hinge variable adjusting groove formed at the second end of the hinge member such that the second end is a movable locking end locked to said body cover at an arbitrary position in said hinge variable adjusting groove.

2. An opening/closing hinge according to claim 1, wherein the fixed locking end is locked to the interior of said body case with a set screw and the movable locking end is locked to the inside of said body cover at an arbitrary position in said hinge variable adjusting groove by using a set screw and a hinge fixing plate.

3. An opening/closing hinge construction for a housing according to claim 2, wherein two of said hinge variable adjusting grooves are formed in parallel on both sides in the width direction of the movable locking end of said hinge member.

4. An opening/closing hinge construction for a housing according to claim 3, wherein said hinge fixing plate extends over said two hinge variable adjusting grooves and is fixed at both ends thereof by set screws so as to be loosened or tightened freely.

5. An opening/closing hinge according to claim 1, further comprising two of said hinge variable adjusting grooves formed in parallel on both sides in the width direction of the movable locking end of said hinge member.

6. An opening/closing hinge according to claim 5, wherein a hinge fixing plate extends over said two hinge variable adjusting grooves which is fixed at both ends with set screws so as to be loosened or tightened freely.

7. A combination of an opening/closing hinge and an equipment housing, said equipment housing including:

a body case having a bottom plate and side plates erected around said bottom plate;

protruding hinge bosses provided on said bottom plate of said body;

a body cover positioned over said body case when said equipment housing is in a closed position; and cover bosses extending from said body cover and aligned with said protruding hinge bosses;

said opening/closing hinge including:

a hinge member being a flexible sheet and having a first end being locked to said protruding hinge bosses, said hinge member being contained within said equipment housing when said body case is closed by said body cover; and elongated hinge variable adjusting grooves formed at said second end of said hinge member such that said second end is a movable locking end locked to said cover bosses at an arbitrary position in said hinge variable adjusting groove.

8. A combination of an opening/closing hinge and an equipment housing according to claim 7, wherein said equipment housing further comprises a hinge fixing plate mounted to said cover bosses for mounting said hinge member to said cover over said elongated hinge variable adjusting grooves.

9. A combination of an opening/closing hinge and an equipment housing, said equipment housing including:

a body case having a bottom plate and side plates erected around said bottom plate;

a body cover positioned over said body case when said equipment housing is in a closed position;

said opening/closing hinge including:

a hinge member being a flexible sheet and having a first end being locked to said bottom plate of said body, said hinge member being contained within said equipment housing when said body case is closed by said body cover; and elongated hinge variable adjusting grooves formed at said second end of said hinge member such that said second end is a movable locking end locked to a bottom surface of said cover at an arbitrary position in said hinge variable adjusting groove.

* * * * *